US006499580B1

(12) United States Patent
Plesh, Sr.

(10) Patent No.: US 6,499,580 B1
(45) Date of Patent: Dec. 31, 2002

(54) INSERT AND METHOD OF INSTALLING THEREOF IN COOLING BED PLATE TRANSFER GRID

(76) Inventor: Ronald L. Plesh, Sr., 31 Hemlock Hill, Orchard Park, NY (US) 14127

( * ) Notice: Subject to any disclaimer, the term of this patent is extended or adjusted under 35 U.S.C. 154(b) by 0 days.

(21) Appl. No.: 09/840,678

(22) Filed: Apr. 23, 2001

Related U.S. Application Data

(63) Continuation-in-part of application No. 09/331,383, filed as application No. PCT/US97/24259 on Dec. 18, 1997, now abandoned, which is a continuation-in-part of application No. 08/768,712, filed on Dec. 18, 1996, now Pat. No. 5,908,102.

(51) Int. Cl.[7] ..... B65G 13/00
(52) U.S. Cl. ..... 193/37
(58) Field of Search ..... 193/35 R, 37

(56) References Cited

U.S. PATENT DOCUMENTS 1,842,396 A 1/1932 Fitch
2,593,089 A 4/1952 Barry
3,509,978 A 5/1970 Bedford
3,514,001 A 5/1970 De Mevitt et al.
3,645,379 A 2/1972 Kornylak
5,265,711 A 11/1993 Plesh, Sr.
5,301,785 A 4/1994 Plesh, Sr.
5,472,179 A 12/1995 Wendt et al.
5,908,102 A 6/1999 Plesh, Sr.
5,927,370 A 7/1999 Plesh, Sr.

*Primary Examiner*—Joseph E. Valenza
(74) *Attorney, Agent, or Firm*—James C. Simmons

(57) ABSTRACT

A high capacity and easy to maintain insert for a cooling bed plate transfer grid. In order that the inserts may be installed or replaced at a remote location thereby requiring removal of the grid to the remote location, the height of the grid is adjustable so that it may be easily re-installed after the servicing at the remote location. The roller height is set to a fixed non-adjustable height during initial insert installation so that, during the subsequent re-installation, there is advantageously no requirement for adjustment of the roller height. This allows the grid and inserts to be easily and quickly re-installed in the field.

11 Claims, 5 Drawing Sheets

FIG. 8
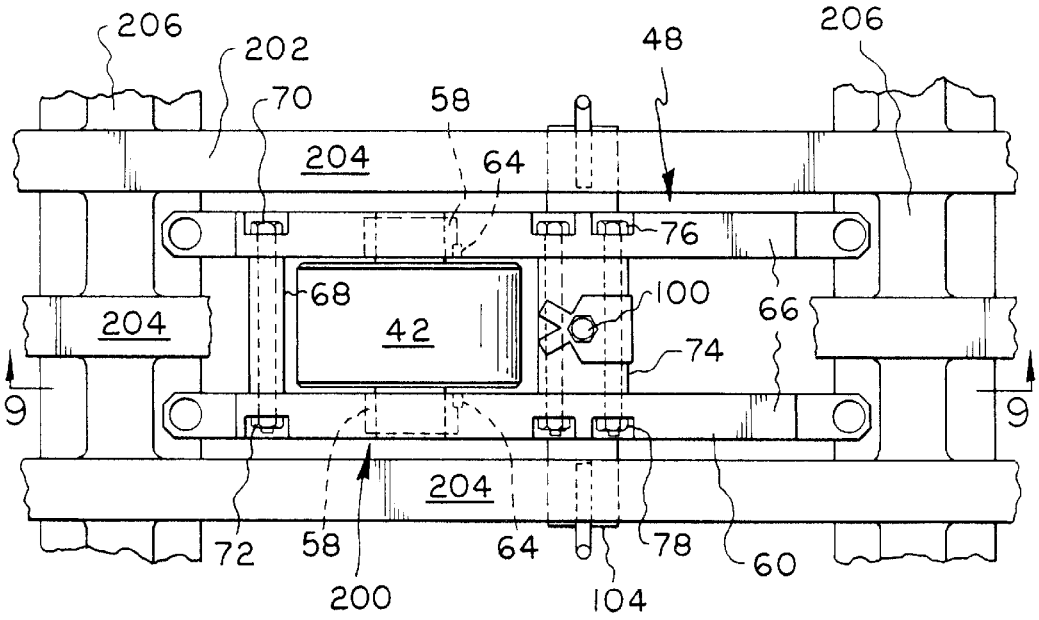
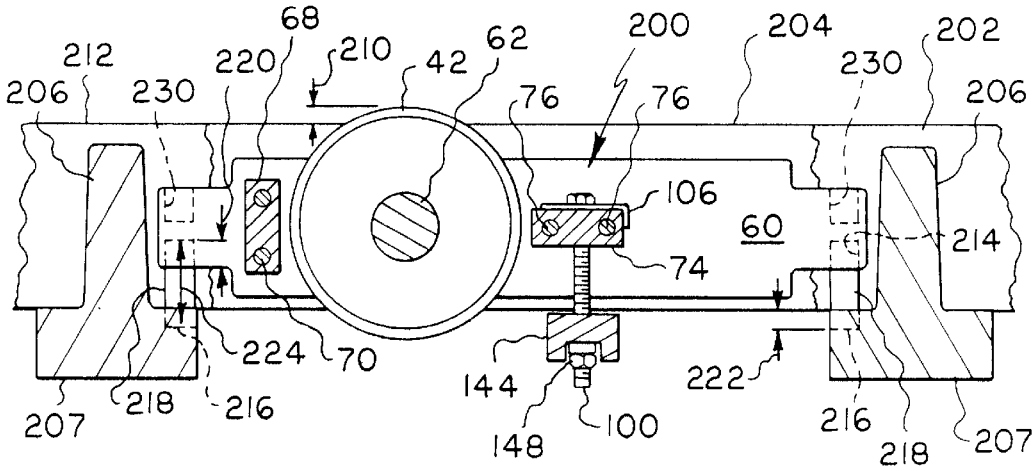
FIG. 9

INSERT AND METHOD OF INSTALLING THEREOF IN COOLING BED PLATE TRANSFER GRID

This application is a continuation-in-part of application Ser. No. 09/331,383, filed Jun. 18, 1999 now abandoned (which is the national stage of PCT application PCT/US97/24259, filed Dec. 18, 1997), which is a continuation-in-part of application Ser. No. 08/768,712, filed Dec. 18, 1996 (now U.S. Pat. No. 5,908,102). The above applications are hereby incorporated herein by reference.

The present invention relates generally to transfer grids for ferrous and non-ferrous metal plates and the like. More particularly, the present invention relates to inserts clamped thereto and supporting rollers which engage plates being transferred so that friction between the plates and the grid is avoided or reduced to thereby eliminate or significantly reduce grid wear. The present invention also relates generally to methods using such transfer grids for cooling such plates.

My prior U.S. Pat. Nos. 5,265,711 and 5,301,785, which are hereby incorporated herein by reference, disclose the clamping of roller supporting inserts in transfer grid pockets for moving of the plates over the rollers. The roller is rotatably mounted by means of a bushing on an axle the ends of which are secured in apertures in plates. Members forward and aft of the roller and sandwiched between and welded to the plates form a frame in which the roller is mounted.

U.S. Pat. No. 5,472,179 suggests a cooling bed plate transfer grid insert which comprises a cast housing which has front and rear end flange portions which seat on successive cross members of the transfer grid and which is clamped by means of J-bolts to these cross members. A roller is mounted in a central slot in the housing. The roller is mounted on the central journal portion of a pin, and the pin further includes rectangular end portions slidably received in vertical slots defined by the housing at opposite sides of the roller. A pair of adjustment screws threadedly engage the end portions of the pin and engage the bottom walls of the side slots so that joint rotation of the screws raises and lowers the roller in a translatory manner.

Such an arrangement is not considered to be sufficiently reliable under the rugged conditions encountered in moving hot heavy plates over cooling beds and is considered to be limited in its capacity to handle very heavy plates.

The inserts disclosed in my aforesaid patents have worked well. However, it is considered desirable to install the inserts in a grid at a remote location (insert supplier's business location) where suitably skilled workers are available to allow the cooling bed operator to make the changeover more quickly and inexpensively and without the need on site for people skilled in insert installation. When the inserts are removed, such as for transport or maintenance, the roller height must be again adjusted. However, the roughness which is typical of unfinished portions of the castings (lower flanges of grid cross-portions) increases the difficulty of adjusting roller height by means of adjusting screws. It is therefore also considered desirable to be able to remove the inserts for transport or maintenance and re-install them at the customer's place of business without the necessity of having to adjust the roller height again, without the need on site for people skilled in insert installation.

Accordingly, it is an object of the present invention to provide an insert which may be removed and re-installed without the need to adjust roller height during such re-installation.

In order to allow removal and re-installation of an insert without the need to adjust roller height during such re-installation, in accordance with the present invention, a non-adjustable fixed height of the roller is set by suitable means such as, for example, pins or brackets or other means which engage the grid so that the roller is at the fixed height, the height-setting means being dis-engageable from the insert body and the grid and re-engageable therewith without the fixed height changing when the height-setting means is re-engaged with the body and the grid.

The above and other objects, features, and advantages of the present invention will be apparent in the following detailed description of the preferred embodiments thereof when read in conjunction with the accompanying drawings wherein the same reference numerals denote the same or similar parts throughout the several views.

BRIEF DESCRIPTION OF THE DRAWINGS

FIG. 8 is a view similar to that of FIG. 2 illustrating an embodiment of the insert which embodies the present invention.

FIG. 9 is a sectional view thereof taken along lines 9—9 of FIG. 8.

DETAILED DESCRIPTION OF THE PREFERRED EMBODIMENTS

Figure 1:
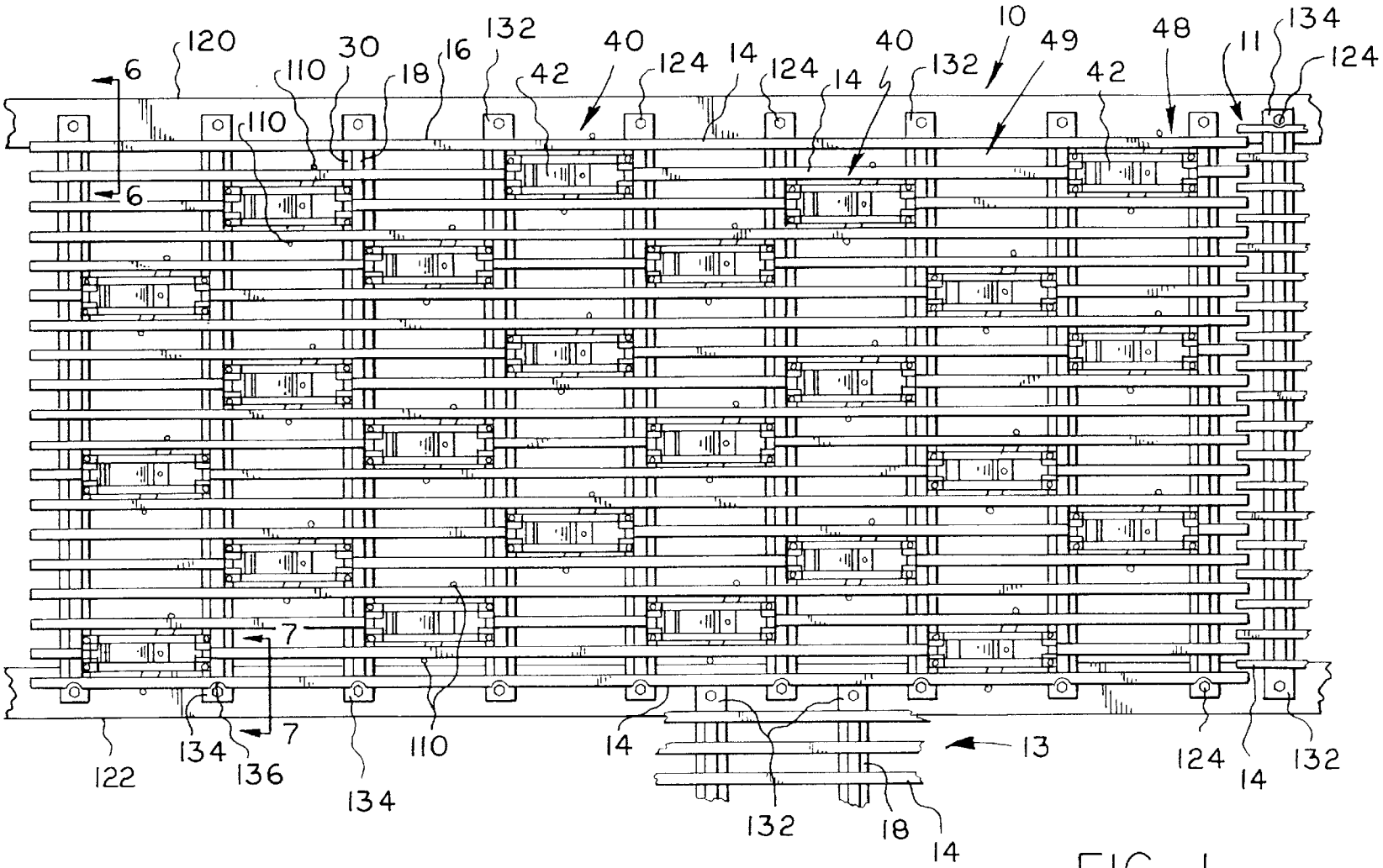
FIG. 1 is a plan view of a plate transfer grid installed in a cooling bed and having a plurality of inserts mounted thereto.
Figure 2:
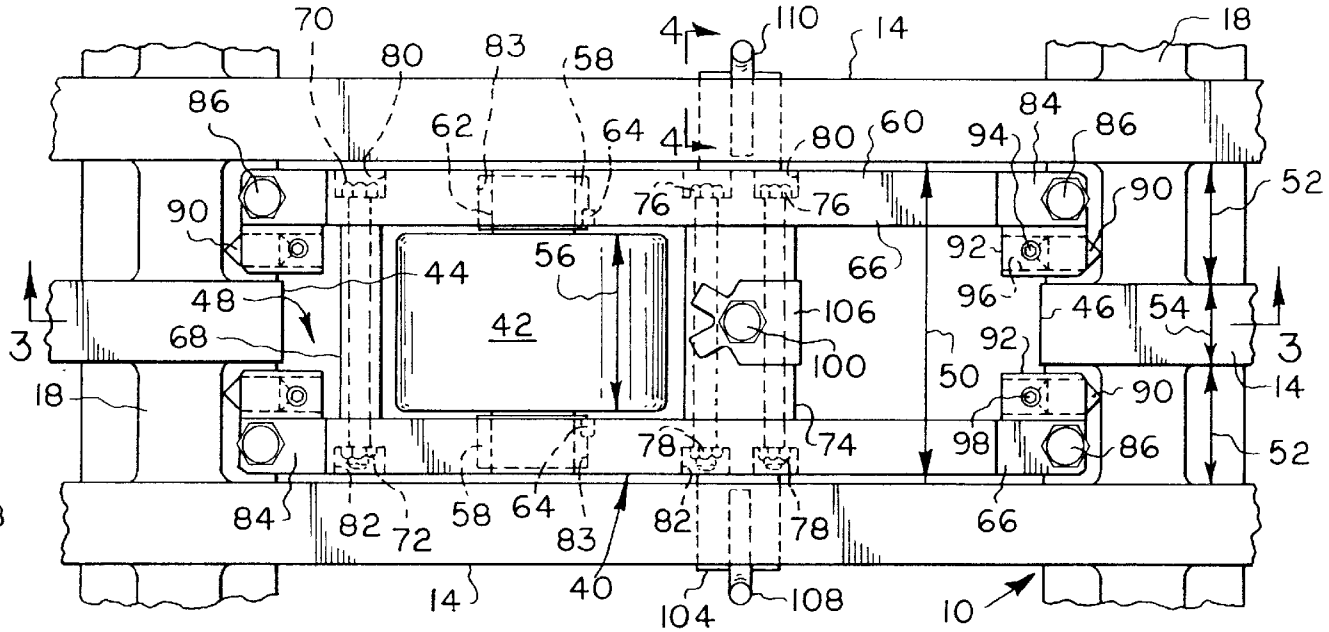
FIG. 2 is an enlarged plan view of one of the inserts mounted to the cooling bed plate transfer grid.
Figure 3:
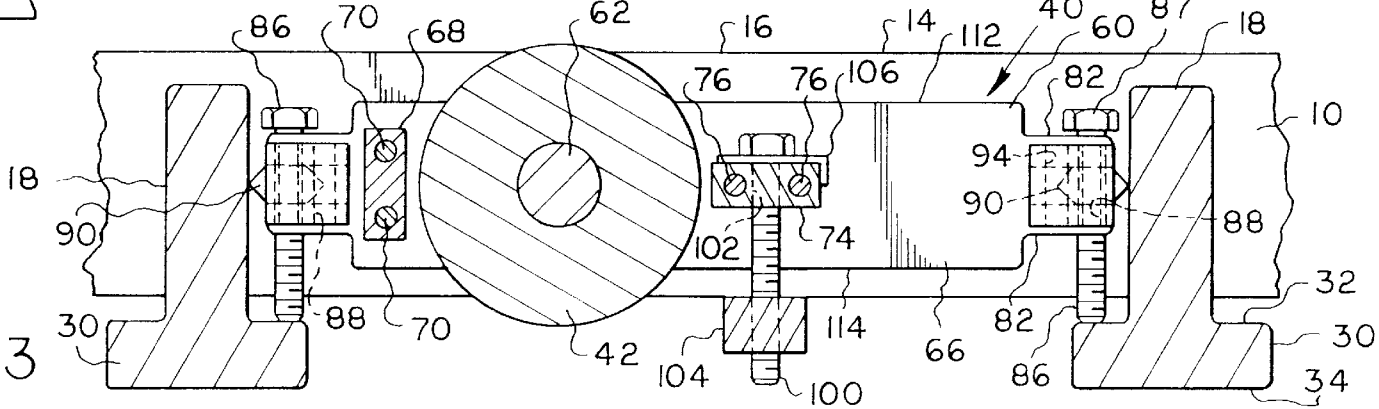
FIG. 3 is a sectional view thereof, with portions of the grid removed for clarity, taken along lines 3—3 of FIG. 2.

Referring to the drawings, there is illustrated generally at 10 a grid which, with a plurality of like grids, forms a cooling bed for transferring hot ferrous and non-ferrous metal plates and for cooling them by air circulation and the passage of time as they are moved therealong such as by chains or the like. The transfer grid 10 is cast or fabricated as a weldment or otherwise suitably constructed in a single piece of iron or other suitable material and includes a plurality of first parallel portions or members 14 extending in the direction of travel of the plates and providing upper surfaces 16 which, without the inserts described hereinafter, frictionally engage the metal plates for sliding movement of the metal plates therealong. The members 14 are supportedly joined by cross-portions or cross-members 18 which extend at right angles thereto. The members 14 project above the cross-members 18 a distance of perhaps about A inch to provide the supporting surfaces 16 receiving the plates and along which the plates are conveyed from left to right, as seen in FIGS. 1, 2, and 3. This distance could be reduced by wear to zero. As seen in FIG. 3, the lower portions of the cross-members 18 are sometimes flanged to provide lower flanges 30 having upper and lower surfaces 32 and 34 respectively. The members 14 and 18 are slightly tapered so as to have a greater thickness at the bottom surfaces thereof. The space bounded by a pair of members 14 and a pair of cross-members 18, which space is generally rectangular, defines a pocket. The transfer grid 10 as so far described is of a type which is conventional in the art and is described in greater detail in my aforesaid patents. The transfer grid 10 and other grids, illustrated at 11 and 13, which are side-by-side and in end-to-end relation therewith respectively, are supported by steel beams 120 or other suitable supports, which extend generally under the outer members 14 which are along opposite side edges of the grid, in a manner which will be discussed in greater detail hereinafter.

The frictional sliding movement of the metal plates over the surfaces 16 of the members 14 causes wear thereof with the result that frequent replacement of the entire grid has been typically required at high cost. In addition, the under surface of the plates may undesirably be marred as they are conveyed along the grid members 14. In my aforesaid patents, a plurality of inserts, providing rollers, are disclosed as being mounted in the pockets in order to eliminate or significantly reduce such wear and marring.

In order to handle heavier/thicker plates as well as to allow a reduction in the number of inserts required, a wider insert, illustrated generally at 40, is provided to support a wider roller 42. The grid 10, for example, has 24 inserts 40 generally evenly dispersed over its area. However, the quantity of inserts installed may vary according to the application or the position of the grid on the cooling bed. In order to accommodate the wider insert 40, a web or portion of a member 14 is removed, as at 44 and 46, over substantially the distance between a pair of adjacent cross-members 18 to provide a modified or relatively wide pocket 48 having a width, illustrated at 50, which is more than twice the width, illustrated at 52, or of the relatively narrow pocket, illustrated at 49, for the grid, i.e., width 50 is equal to twice width 52 (distance between adjacent members 14) plus the width, illustrated at 54, of the member 14. This thus permits the width of the insert 40 to be, for example, perhaps about 5½ inches as compared to a width of perhaps about 2 inches for the inserts disclosed in my aforesaid patents. As a result, the roller 42 may have a much greater width, illustrated at 56, of perhaps about 3.38 inch for the desired greater capacity. Such a larger capacity insert may also be suitable for placement on the leading and trailing ends of the cooling bed where heavy duty 6 inch wide "torpedo" rollers have been heretofore mounted to the frame or apron structure.

In order to provide increased bearing capacity of perhaps 2 to ½ times the capacity for handling the larger capacity roller 42, the bearings, illustrated at 58, for the roller 42 are mounted in the insert frame, illustrated at 60, as discussed in greater detail hereinafter.

The roller 42 has a shaft or axle 62 which rotatably engages the bearings 58, and a spring pin, illustrated at 64, is provided for each bearing 58 for prevention of bearing rotation. In order that the roller 42 and axle 62 may more durably be of a single piece construction as well as to allow easier repair and rebuilding, the frame 60 is of a modular construction as follows. The frame 60 includes a pair of parallel elongate members or weldments 66 which extend parallel to the grid members 14 when the insert 40 is mounted in the pocket 48. The frame members 66 are detachably attached by suitable means such as (1) a plate 68 which is adjacent the leading end portion of the insert and which extends between and is attached to frame members 66 by a pair of vertically spaced hex head bolts 70 and hex nuts 72 or by other suitable means, and (2) a plate 74 which is intermediate the insert ends (generally centrally thereof) and which extends between and is attached to frame members 66 by a pair of horizontally spaced hex head bolts 76 and hex nuts 78 or by other suitable means. The heads of the bolts 70 and 76 are suitably received within recesses 80 respectively in one of the frame members 66. The nuts 72 and 78 are suitably received within recesses 82 respectively in the other of the frame members 66. The bearings 58, which may be suitable high temperature bearings, are suitably received in bores 83 in the frame members 66 respectively. Thus, the bearings 58 may be easily replaced by removing the bolts 70 and 76 so that the frame members 66 are detached and the axle 62 removed from the bearings 58 for their replacement. As a result, the roller 42 and axle 62 may desirably be of single piece construction.

The end portions 84 of the insert members 66 are vertically stepped inwardly, as illustrated at 82, thereby providing reduced thickness end portions. A hex head screw 86 is threadedly received in a vertical threaded aperture 88 in each of the end portions 84 to extend below the respective end portion 84 and engage the upper surface 32 of the respective flange 30 whereby to effect resting of the insert on the flanges and allow adjustment of the height of the insert by manipulating the screws 86. Hex heads 87 on the screws 86 are provided to eliminate the periodic cleaning which may be needed for alien screws and to allow easier adjustment with standard socket wrenches. The steps 82 are suitably sized so that the hex heads on screws 86 do not undesirably protrude above members 66 and interfere with plates passing over the insert.

Welded or otherwise suitably attached to each of the end portions 84, inwardly thereof, is a member 92 in which is suitably contained in a horizontal bore 96 thereof a plunger pin 90 with cone-shaped ends. Each plunger pin 90 is oriented to protrude from the respective bore for engaging the respectively adjacent cross-member 18 for longitudinally stabilizing the insert 40. If desired, similar plunger pins may be alternatively or additionally provided for laterally stabilizing the insert, as disclosed in my aforesaid patents. Vertical threaded apertures 94 in members 92 extend from the upper surfaces thereof downwardly to the lower surfaces thereof over the entire height thereof, and the plunger pin bores 96 open into apertures 94 respectively. Plunger screws 98 in the form of set-screws are threadedly received in the vertical apertures 94 for engaging the plunger pins 90 respectively for adjusting insert longitudinal stability. The plunger screws 98 have cone points on their lower ends which may taper at an angle of perhaps about 45 degrees to engage the similar points (cone-shaped ends) on the inner ends of the plunger pins 90, at generally the same angle, to force the plunger pins 90 outwardly a suitable distance to achieve the desired stability. The plunger screws may be provided with lock nuts.

A hex head bolt 100 is received in a vertical aperture 102 in cross-member 74 and centrally disposed between the longitudinal frame members 60 to extend below the cross-member 74. An elongate member 104 is threadedly engaged by the lower end portion of the bolt 100 and has a length to extend under both of the longitudinal frame members 60 for clamping the insert 40 to the grid 10. Thus, with the roller height adjusted by means of screws 86, the bolt 100 may be turned to swing the member 104 so that it is oriented cross-wise to the frame members 66 and under both of the grid members 14. The bolt 100 is then manipulated while holding the member 104 in the orientation so as to clampingly tighten the clamping member 104 to the grid members 14. The height adjusting screws 86 and clamping bolt 100 may be alternately manipulated until the roller position is suitably obtained, and the plunger pins 90 are also suitably adjusted by means of screws 98 until the insert is suitably stabilized. A locking tab washer 106 is provided for the clamping bolt 100 and suitably tack-welded or formed/bent to the member 74 to prevent the bolt 100 from working loose over time.

While one embodiment of mounting means for the insert is described herein, it should be understood that the insert may be mounted in various other ways such as, for example, disclosed in my aforesaid patents, and such other suitable mounting means are meant to come within the scope of the present invention.

Figure 4:
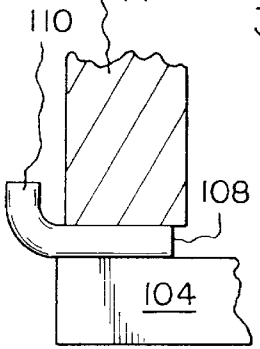
FIG. 4 is a detail sectional view taken along lines 4—4 of FIG. 2.

As seen in FIG. 4, an L-bar 108 is welded or otherwise suitably attached to each end of the clamping member 104 to have a portion 110 which extends upwardly from the clamping member end to engage the side of the respective grid member 14 to prevent the clamping member 104 from rotating and thereby working loose. Alternatively, a plate or other suitable member may be welded or otherwise suitably attached to each end of the clamping member 104, or the clamping member may be formed to have a portion integrally formed therewith at each end thereof to lie above the plane of the remainder of the clamping member for engaging the sides of the grid members 14 respectively for preventing clamping member rotation. As seen in FIG. 1, the clamping members 104, with the L-bar portions 110 at each end, are accordingly skewed to the transverse direction of the grid.

It can be seen that all of the apertures 88, 94, and 102 extend all of the way through their respective members so as to open out at both the bottom and upper sides or surfaces thereof. This permits the respective screws or bolts to be received in the apertures from either end thereof. The steps 82 on the lower surfaces 114 of members 66 allow the hex heads of bolts 86 to be recessed or out of the way if inserted from the lower surfaces 114 as well as the upper surfaces 112 of the members 66. In addition, it can be seen that the roller 42 extends radially outwardly of the lower surfaces 114 as well as upper surfaces 112 of members 66. The insert 40 is thus suitably constructed so that it can be used in the position shown in the drawings or in an inverted (upside down or turned over 180 degrees) position wherein the upper surfaces 112 become the lower surfaces and the lower surfaces 114 become the upper surfaces. The mounting of the bearings 58 in the frame 60 causes the bearings to experience contact (i.e., wear) on only one side. In order to achieve longer (i.e., twice) the bearing life, the wear on the bearings 58 may be monitored, and, when they have worn by a certain amount (perhaps about 90% worn), the insert 40 is desirably inverted (removed from the pocket and re-mounted upside down in the pocket) to thereby expose the unworn portions of the bearings to the contact and in effect have new bearings.

Thus, the insert 40, and its method of installation and use, is provided to have high capacity for handling heavy/thick plates while achieving long bearing life in a modular construction which allows ease of bearing replacement as well as other repair and rebuilding thereof.

Figures 5, 6, 7:
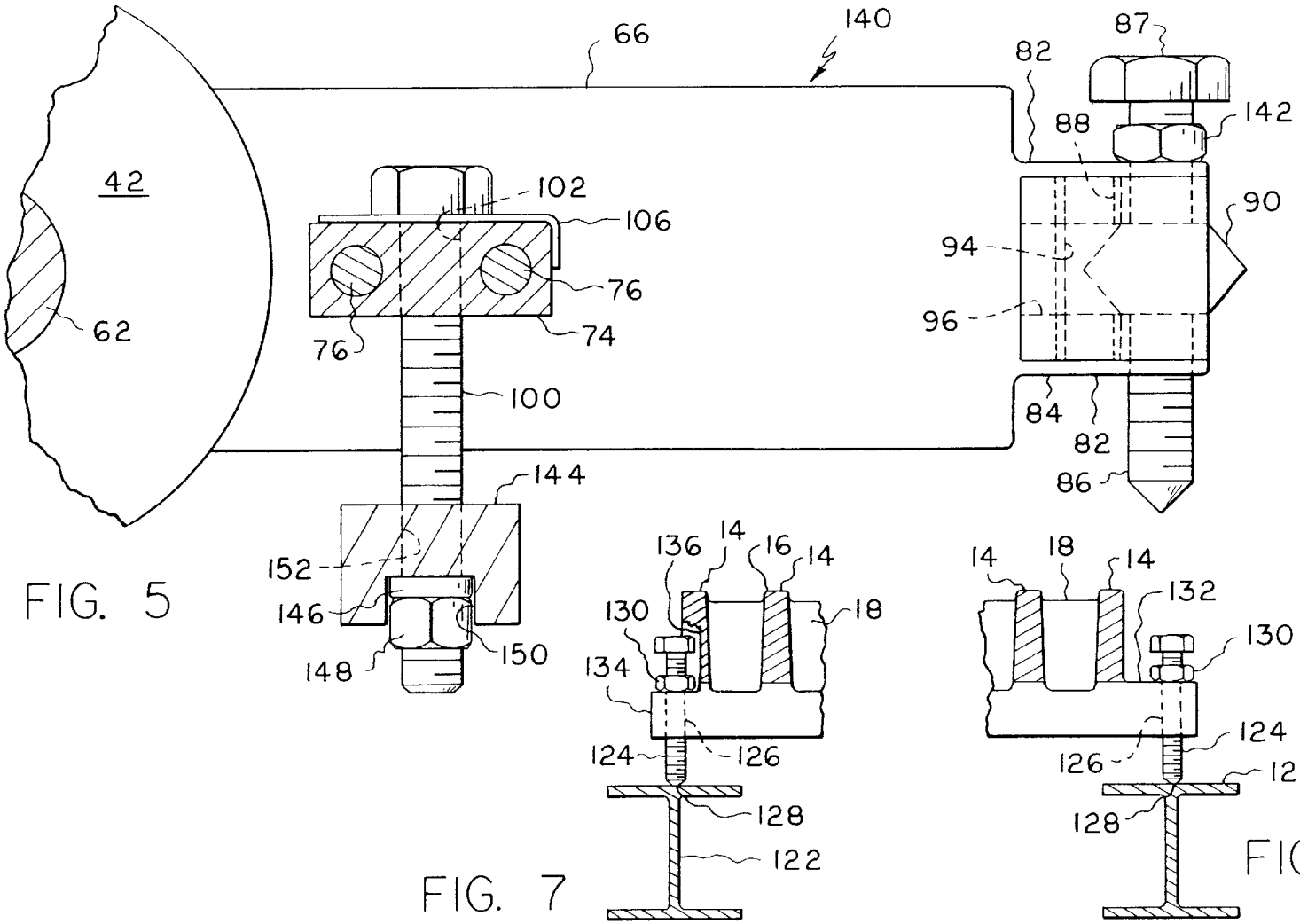
FIG. 5 is a partial view similar to that of FIG. 3 and enlarged illustrating an alternative embodiment of the insert.
FIG. 6 is an enlarged sectional view of the grid taken along lines 6—6 of FIG. 1.
FIG. 7 is an enlarged sectional view of the grid taken along lines 7—7 of FIG. 1.

Referring to FIG. 5, there is illustrated at 140 an alternative embodiment of the insert which is similar to insert 40, except as described hereinafter. As seen in FIG. 5, a lock nut 142 is provided on each of the screws 86 adjacent the screw head 87 to prevent them from working loose.

In the embodiment of FIG. 5, the lower end of the bolt 100 is received in an unthreaded aperture 152 of elongate clamping member 144 which, like clamping member 104, has a length to extend under the correspondingly adjacent members 14 and may have L-bars 108 or other suitable members attached to or integral therewith for preventing rotation of the clamping member 144. A spring/split lock-washer 146 and a nut 148 are received in a pocket or recess 150 in the lower surface of the clamping member 144. The aperture 152 opens into the recess 150, which is sized to prevent rotation of the nut 148. The lower end of the bolt 100, after passing through the aperture 152 and spring washer 146, threadedly engages the nut 148 so that, by turning the bolt 100, the clamping member 144 may be caused to tightly engage the members 14 for clamping the insert 140 to the grid 10. The spring lock-washer 146 is provided to maintain a tight clamping force with the grid during conditions in which, during use of the grid, portions thereof may receive high concentrations of heat and expand or distort such that the clamping member 144 would otherwise become loose for a period of time, the spring effect of the lock washer 146 for maintaining clamping pressure until the grid stabilizes.

Since the installation or replacement of inserts is a procedure best handled by skilled workers, it is considered desirable that such a procedure be handled not at the site of operation of the cooling bed but at a remote site, i.e., the insert supplier's business, where workers skilled in installing inserts are available. This would allow the cooling bed operator to more quickly and inexpensively complete a changeover, using less skilled workers and with less fatigue to the installers. However, it is necessary that all of the grids be the same height, but the support structure under the grids is not consistent enough to allow all of the grids to be the same height when mounted thereon. The insertion of shims to adjust the grid height has undesirably been a cumbersome process, and, due to the effects of extreme temperature changes, shims may have to from time to time be added or subtracted. In order to allow the cooling bed operator to easily and quickly replace a grid 10 after installation or replacement or repair of inserts at a remote site and thereafter easily and quickly re-adjust its height, a plurality of perhaps 9 height adjusting bolts 124 are spaced along each of the opposite sides of the grid 10, as seen in FIGS. 1, 6, and 7.

Bolts 124 may be fully threaded hardened bolts which are threadedly received in drilled and tapped apertures 126 in the grid 10, as described hereinafter. The bottom ends of the bolts 124 terminate in cone points 128 for "digging into" and forming mating cavities in the upper surfaces of the beams 120 and 122 respectively. A hex jam nut 130 is received on the bolt 124 to "lock" the grid at the desired height when the bolts 124 have been suitably manipulated to achieve the desired height. The adjusting bolts 124, in addition to providing ease of adjustment of grid height, also act as insulators, i.e., to isolate the beams 120 and 122 partially from heat which is transferred to the grids by the hot metal plates to thereby reduce the effects of the heat on the beams.

One side of the grid 10 (under which beam 120 of FIG. 6 is located) has a plurality of second member extension portions or foot pads 132 containing the apertures 126.

The other side of the grid 10 (under which beam 122 of FIG. 7 is located) has second member extension portions 134 which extend outwardly a smaller distance than foot pads 132 extend. In order to provide room for the hex heads of bolts 124 and for the nuts 130, generally semi-circular portions are milled from the adjacent member 14 to provide generally semi-cylindrical grooves, illustrated at 136, therein.

End-to-end grids 10 and 11 are shown in FIG. 1 to be placed with members 14 in grid 10 offset from members 14 in grid 11. As a result, the side of grid 11 under which beam 120 partially lies is provided with the extension portions 134, while the other side is provided with the foot pads 132 of FIG. 6. Side-by-side grids 10 and 13 are shown to be placed with members 18 in grid 10 offset from members 18 in grid 13, and with foot pads 132 of grid 13 in an alternating relationship with the extension portions 134 of grid 10. However, it should be understood that the grids can be laid in other ways such as in abutting relationships. Alternatively, a grid may have foot pads 132 along both sides or extension portions 134 along both sides. The adjusting bolts may alternatively be provided along both of the sides which constitute ends, i.e., which extend in a direction parallel to the second members 18.

While the relatively wide pockets 48 are needed for the wider inserts 40, if the first members 14 were spaced so that all of the pockets were relatively wide pockets 48, then it would be difficult for workers to walk on the grids. In order to provide ease of movement of workers over the grids, they are thus constructed or adapted, as previously discussed, to provide a suitable number of relative wide pockets 48 for receiving inserts 40 or 140 and with the remaining grid space having relative narrow pockets 49.

Grid height may alternatively be adjusted with a series of opposing wedges (adjustable shims) between the grid support feet and the supporting structure. If desired, grid height may be adjusted by means of a combination of adjusting screws 124 (for ease of adjustment) and shims or opposing wedges (for strength) placed between the grid support feet and the supporting structure.

Referring to FIGS. 8 and 9, there is illustrated generally at 200 an insert installed in a plate transfer grid 202 in accordance with the present invention, the insert 200 and grid 202 being similar to insert 140 and grid 10 respectively except as discussed hereinafter. Thus, grid 202 includes a plurality of first parallel portions 204 similar to members 14 and a plurality of cross-portions 206 similar to cross-portions 18.

When the inserts 40 and 140 of FIGS. 1 to 7 are removed and re-installed, the roller height must be again adjusted. Moreover, the roughness which is typical of unfinished portions of the castings, i.e., the lower flanges 208 of cross-portions 206, increases the difficulty of adjusting roller height by means of adjusting screws 86. In order that the re-installation of an insert may be easier, especially by the user, in accordance with this embodiment the roller height is set at the time of initial installation of the insert, as hereinafter discussed, so that, at the time of re-installation after removal from the pocket, the insert is installed to the set roller height, and no adjustment of the roller height is required. This thus allows the insert manufacturer to initially set the roller height at the time of initial installation, which may be done desirably at the insert manufacturer's place of business since the grid height may be adjusted in accordance with the previously described grid height adjustment means of FIGS. 6 and 7, and re-installation as part of maintenance and repair may then be easily conducted by the user (customer) without the requirement of adjusting the roller height.

In order to set the roller height, i.e., the distance, illustrated at 210, which the roller 42 extends above the upper surface 212 of the grate 202, which may, for example, be about 0.25 inch, in accordance with a preferred embodiment of the present invention, a hole, illustrated at 214, is drilled or otherwise suitably formed in the lower surface of each end portion of each of the frame members 66, the holes 214 overlying the respective flanges 207. Holes, illustrated at 216, are also formed, preferably by drilling, in the upper surfaces of the flanges 207 to align with the holes 214 respectively, and the end portions of a cylindrical rod or pin 218, composed, for example, of steel, are inserted in each hole 214 and the corresponding hole 216 respectively. The drilling of holes in the coarsely formed flanges 207 is easier than, for example, attempting to manipulate adjusting screws 86 thereon. The depths of the holes 214 and 216, illustrated at 220 and 222 respectively, and the length, illustrated at 224, of the pin 218 are selected (predetermined) to set the desired roller height 210. The depths 220 of holes 214 may, for example, suitably be about ½ inch. For a new grate 202, the depths 222 of holes 216 may, for example, suitably be about ¼ inch, and the length 224 of pin 218 may, for example, be about 2 inches to achieve a roller height 210 of about 0.25 inch. A grate to be retrofitted with inserts may have worn as much as perhaps 1 inch. However, a 1¼ inch hole in a flange 207 may unduly weaken the corresponding cross-portion 206. For a grate worn by as much as 1 1/16 inch, the depths 222 of holes 216 may, for example, suitably be about 5/16 inch, and the length 224 of pins 218 may, for example, be about 1 inch to achieve the desired roller height 210 of about 0.25 inch. The pins 218 may be supplied in uniform lengths 224 of, for example, 1, 1 ½, and 2 inches so that a suitable pin length may be selected for each grid to be fitted or retrofitted, and the holes 216 then drilled to the depth necessary for the selected pin length to achieve the desired roller height 210. The diameter of pins 218 may, for example, be about ¾ inch, and the diameters of holes 214 and 216 is desirably such as to afford a slip fit of the pins 218 therein, i.e., a fit so that the pins are removable but snug so that there is no looseness.

In order that the insert 200 may be removed and re-installed in the inverted orientation to increase bearing life, as previously discussed with respect to the embodiments of FIGS. 1 to 7, a hole, illustrated at 230, which is similar in depth, diameter, and location as hole 214, is drilled or otherwise suitably formed in the upper surface (which becomes the lower surface when the insert is inverted) of each end portion of each frame member 204.

In order to remove the insert 200 for repair or maintenance or to invert the insert for longer bearing life, the insert is unclamped by loosening bolt 100 and effecting rotation of clamping member 144 so that grid portions 204 are cleared, and the insert may then be lifted up, with the pins 218 perhaps remaining in holes 216. If desired, the pins 218 may be tack welded, brazed, glued, or otherwise more tightly held in holes 216 than in holes 214 so that they remain in holes 216 when the insert is removed. The insert may then be re-installed in the same orientation by lowering the insert so that the upper end portions of the pins 218 are received in holes 214 respectively or in the inverted orientation by lowering the insert so that the upper end portions of the pins 218 are received in holes 230 respectively whereby, since the depths of holes 214 and 230 are the same, the set roller height 210 is easily achievable by the customer (user) without the necessity of manipulating adjusting screws or otherwise performing difficult adjustments to obtain the roller height 210. This thus allows field removal for maintenance and repair and re-installation to be very easy and less time consuming.

Figure 10:
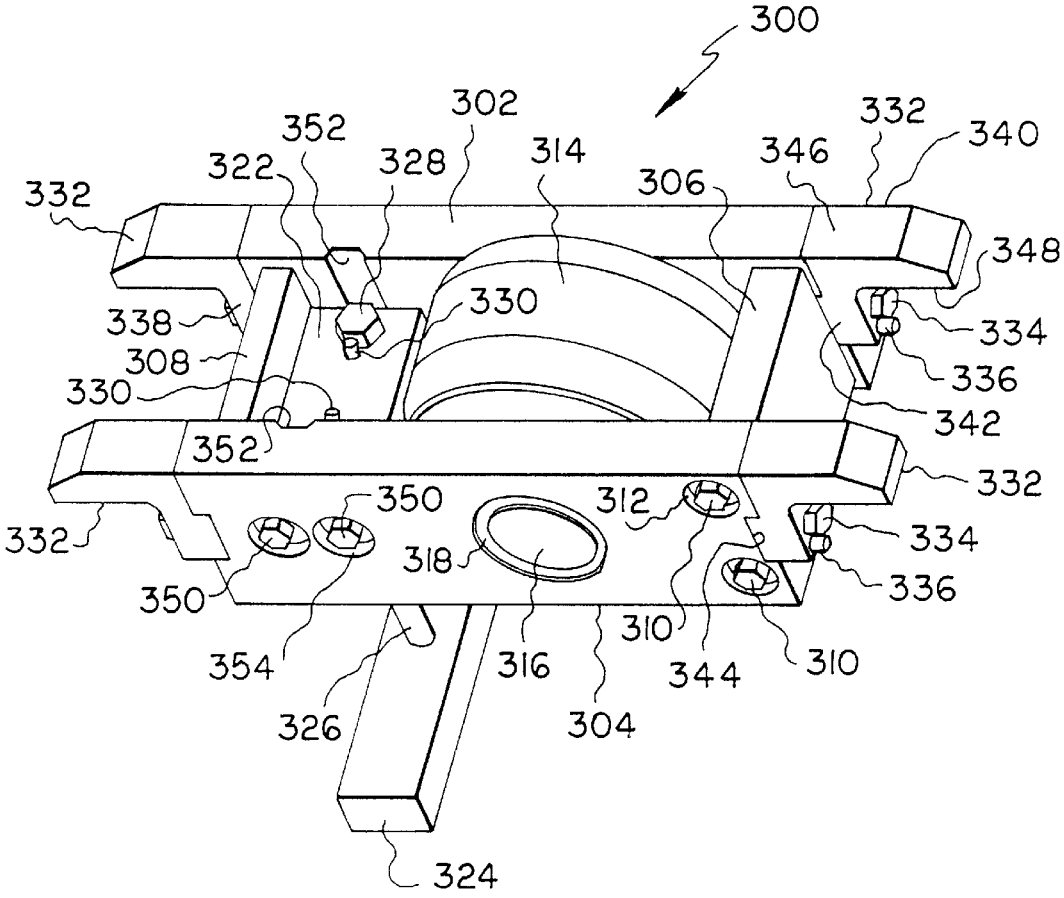
FIG. 10 is a perspective view of an insert in accordance with an alternative embodiment of the present invention.

Referring to FIG. 10, there is illustrated generally at 300 an insert installable in a plate transfer grid 10 in accordance with an alternative embodiment of the present invention. The insert 300 comprises a pair of spaced frame members 302 and 304 joined by a pair of spaced cross-members 306.

and 308. Cross-member 306 is joined to frame members 302 and 304 by a pair of vertically spaced screws 310 which extend through the length of member 306 and are received in countersunk apertures, illustrated at 312, in the members.302 and 304, and the heads and nuts therefor are received in the countersunk apertures respectively. Cross-member 308 is welded to cross-member 322. It should of course be understood that-the insert frame may be otherwise suitably assembled.

A roller 314, with a unitary axle 316, is rotatably received between the frame members 302 and 304 and between the cross members 306 and 308, the axle being rotatably received in suitable bearings 318 which are received in holes, illustrated at 320, in the frame members 302 and 304, similarly as wheel 42 is rotatably mounted.

Disposed between the roller 314 and the cross-member 308 is a member 322 which extends between the frame members 302 and 304 and is joined thereto by a pair of horizontally spaced screws 350 which extend through the length of member 322 and are received in countersunk apertures, illustrated at 354, in the members 302 and 304, and the heads and nuts therefor are received in the countersunk apertures respectively. Each of the end edges of the member 322 has a tongue (not shown) which is received in a respective locating groove, illustrated at 352, in the respective frame member 302 and 304 so as to precisely position the member 322. A clamp plate, 324 is mounted to the member 322 by a pair of screws 326 which preferably have hex heads 328 and which are engaged to the clamp plate 324 to draw the clamp plate 324 up tightly against the grid members 14 to thereby tightly clamp the insert 300 to the grid 10, similarly as discussed relative to FIG. 5. A locking pin 330 is provided to engage a flat of the hex head 328 to lock the screw 326 in position to maintain tight clamping engagement of the grid. Other suitable means may be provided for clamping the insert to the grid, such as, for example, the clamping devices shown and described in my U.S. Pat. No. 5,301,781, which is incorporated herein by reference.

In order to provide a non-adjustable fixed height for the roller 314, in accordance with the present invention, a bracket 332. is fixedly attached to each end of each of the frame members 302 and 304. Each bracket 332 has a vertical portion 338 and a horizontal portion 340. The vertical portion 338 is attached to a the respective frame member by screws 334 having hex heads and by locking pins 336 for preventing loosening of the screws 334 or by other suitable means. The lower part of the vertical portion 338 is stepped to define a tongue 342 which is received in a corresponding groove, illustrated at 344, in the respective frame member to precisely locate the position of the respective bracket 332 vertically. The horizontal portion 340 has an upper surface 346 which is desirably flush with the upper surface of the respective frame member and whose outer end slopes downwardly in order to reduce the possibility of distorted plates hanging up. The horizontal portion 340 also has a lower surface 348 which overlies (rests) on a portion of a grid member when the insert 300 is clamped to the grid to thereby provide a fixed and non-adjustable roller height.

Thus, like the embodiment of FIGS. 8 and 9, the roller height of insert 300 is set so that it is fixed and non-adjustable so that it will not be inadvertently changed when the insert is removed for transport or maintenance, thereby allowing the insert to be re-installed by unskilled workmen at a customer's plant without fear that it will be reinstalled at an incorrect height. Of course, if is necessary to-change the fixed height, this may be achieved. by substituting brackets having the surfaces 348 at a different height to provide the new fixed height.

Other means may be provided for setting a fixed non-adjustable roller height, in addition to the embodiment shown in FIGS. 8 and 9 and the embodiment shown in FIG. 10. For example, a single bracket having a width-equal substantially to the insert width may be substituted for the pair of brackets at one or each end of the insert. For another example, the brackets may be mounted on the sides rather than the ends of the insert. For yet other examples, washer spacers may be provided to change the pin height, or holes of different depths may be provided for receiving the same pin to achieve different fixed roller heights, or holes in the surfaces 348 for receiving pins of different lengths, or holes of different depths in the surfaces 348 for receiving pins.

It should be understood that, while the present invention has been described in detail herein, the invention can be embodied-otherwise without departing from the principles thereof, and such other embodiments are meant to come within the scope of the present invention as defined by the appended claims.

What is claimed is:

1. An insert for a cooling bed plate transfer grid having a plurality of elongate parallel first members and a plurality of elongate second members extending crosswise to the first members, the insert comprising a body, a roller which is rotatably mounted to said body to project above said body, means for clamping said body to the transfer grid, and means for setting a height of said roller so that said roller projects above the grid and so that the insert is removable from and then re-clampable to the grid with said roller at the set height and without adjusting the roller height, wherein said height setting means comprises a plurality of pins of a predetermined length having first end portions receivable in holes of a predetermined depth in the insert and having second end portions receivable in holes of a predetermined depth in the grid respectively.

2. An insert according to claim 1 wherein said body is adapted to be removed and re-installed in an inverted orientation.

3. An insert according to claim 2 wherein said height setting means further comprises a first plurality of holes of a predetermined depth in a lower surface of the insert for receiving the first end portions respectively of the plurality of pins and a second plurality of holes of the predetermined depth in an upper surface of the insert for receiving the first end portions of the plurality of pins when the insert is re-installed in the inverted orientation.

4. An insert according to claim 1 further comprising an axle for said roller, and bearing means in said body for rotatably receiving said axle, wherein said body comprises a pair of elongate generally parallel members, said bearing means comprises a bearing in each of said elongate body members for rotatably receiving said axle, and the body further comprises means for detachably attaching said elongate body members together with said axle rotatably received in said bearings.

5. A cooling bed plate transfer grid comprising means including a plurality of elongate parallel first members and a plurality of elongate second members extending crosswise to said first members for receiving hot metal plates formed in a plate mill for passage of the plates for cooling thereof and further comprising means for installing an insert thereto and for removing and re-installing the insert thereto without adjusting height of a plate-engaging roller thereof, wherein said installing means comprises a plurality of holes of predetermined depth in the grid for receiving second end portions respectively of pins of predetermined length and first end portions of which are receivable in a plurality of holes respectively of predetermined depth in the respective insert for setting the roller height.

6. A plate transfer grid according to claim 5 further comprising at least one insert having a roller for engaging the plates, wherein said first holes are disposed in both upper and lower surfaces of said insert wherein the insert is removable and re-installable in an inverted orientation without adjusting the roller height.

7. A plate transfer grid according to claim 5 further comprising a plurality of adjusting screws spaced along each of a pair of opposite sides of the grid for engaging grid support members for adjusting height of the grid.

8. A method for installing in a cooling bed plate transfer grid, over which hot metal plates newly formed in a plate mill are passed for cooling thereof, at least one insert having a roller for engaging the plates so that the insert is removable and re-installable without adjusting the roller height comprising (a) forming a plurality of holes of predetermined depth in the grid, (b) forming a plurality of holes of predetermined depth in the insert, and (c) inserting first end portions of pins having a predetermined length into the grid holes and second end portions thereof into the insert holes respectively thereby to set the roller height.

9. A method according to claim 8 wherein the step of forming the holes in the insert comprises forming the insert holes in both the upper and the lower surfaces of the insert whereby the insert is re-installable in an inverted orientation without adjusting the roller height.

10. A method according to claim 8 further comprising removing the grid before mounting the insert thereon, replacing the grid after mounting the insert thereon, and adjusting height of the grid.

11. A method according to claim 8 wherein the step of adjusting the grid height comprises manipulating a plurality of adjusting screws which are spaced along each of two opposite sides of the grid.

* * * * *